US007364535B1

(12) United States Patent
Rosenow et al.

(10) Patent No.: US 7,364,535 B1
(45) Date of Patent: Apr. 29, 2008

(54) EXERCISE APPARATUS WITH ZERO CLEARANCE ROLLER SEAT CARRIAGE

(75) Inventors: Charles J. Rosenow, Ramsey, MN (US); Lon L. Monsrud, Andover, MN (US)

(73) Assignee: Brunswick Corporation, Lake Forest, IL (US)

( * ) Notice: Subject to any disclaimer, the term of this patent is extended or adjusted under 35 U.S.C. 154(b) by 65 days.

(21) Appl. No.: 11/361,903

(22) Filed: Feb. 24, 2006

(51) Int. Cl.
*A63B 21/062* (2006.01)
*A63B 21/06* (2006.01)
*A63B 26/00* (2006.01)

(52) U.S. Cl. ..... 482/101; 482/94; 482/142

(58) Field of Classification Search ..... 482/94
See application file for complete search history.

(56) References Cited

U.S. PATENT DOCUMENTS 6,632,160 B2 * 10/2003 LaFond et al. ..... 482/95

* cited by examiner

*Primary Examiner*—Terrence R. Till
*Assistant Examiner*—Ryan Durcik
(74) *Attorney, Agent, or Firm*—Andrus, Sceales, Starke & Sawall, LLP

(57) ABSTRACT

Exercise apparatus has a biased tolerance-compensating engagement system between a seat-supporting carriage and a tubular support column to provide zero clearance between adjustment rollers and the support column, to minimize wobble during user adjustment.

8 Claims, 5 Drawing Sheets

10
20
22
24
26
28
30
3
3
12
14
16
18
32
34
36
56
58

EXERCISE APPARATUS WITH ZERO CLEARANCE ROLLER SEAT CARRIAGE

BACKGROUND AND SUMMARY

The invention relates to exercise apparatus.

Exercise apparatus is known having a user seat supported on a carriage which is adjustably supported on a support column of a frame for up-down movement therealong to a plurality of positions to provide an adjustable seat position for the user.

The present invention arose during continuing development efforts directed toward the noted exercise apparatus, including elimination of side-to-side wobble when the user adjusts the seat prior to performing an exercise.

DETAILED DESCRIPTION

Figure 1:
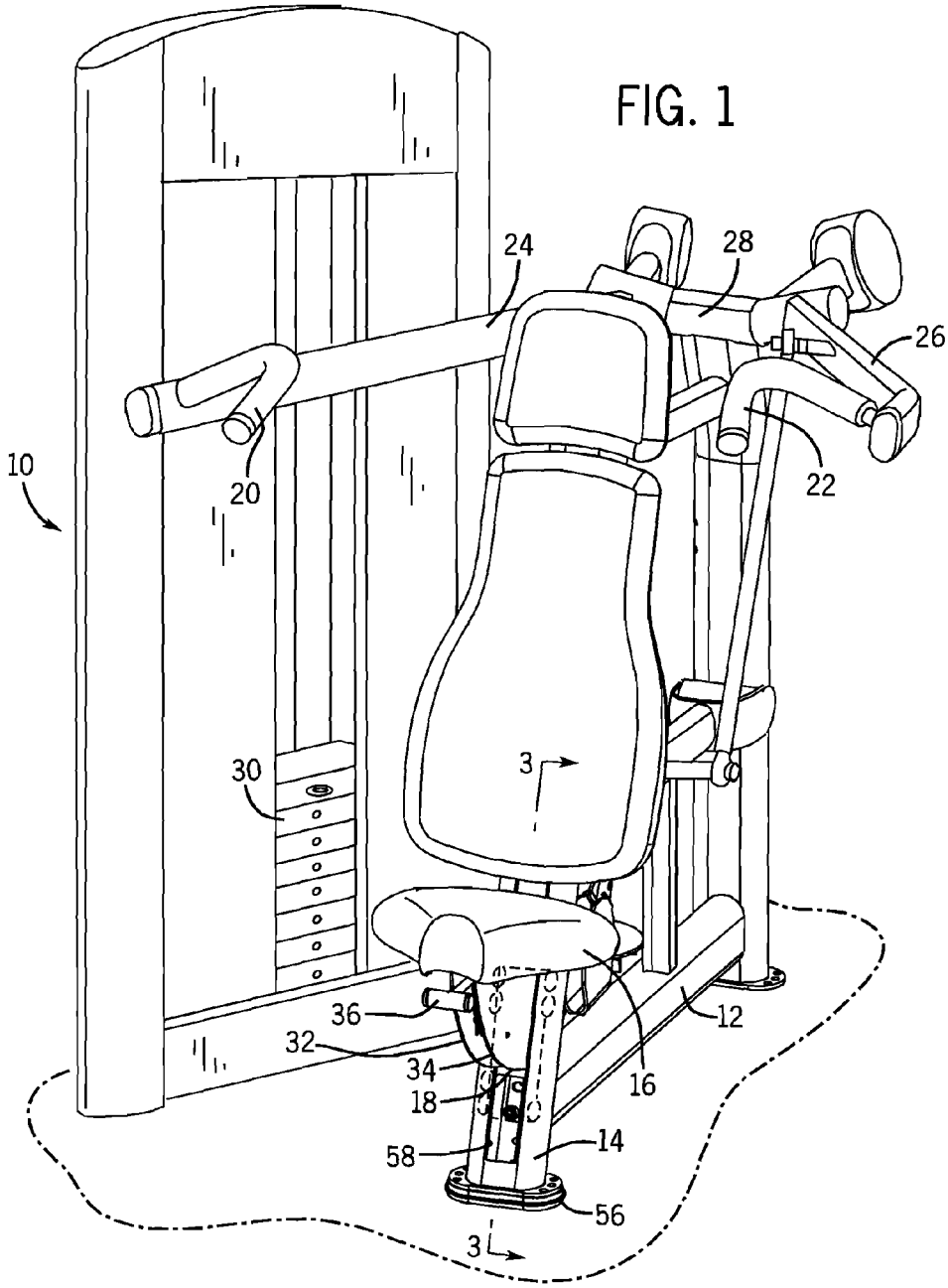
FIG. 1 is a perspective view of exercise apparatus including a user adjustable seat in accordance with the invention.
Figure 2:
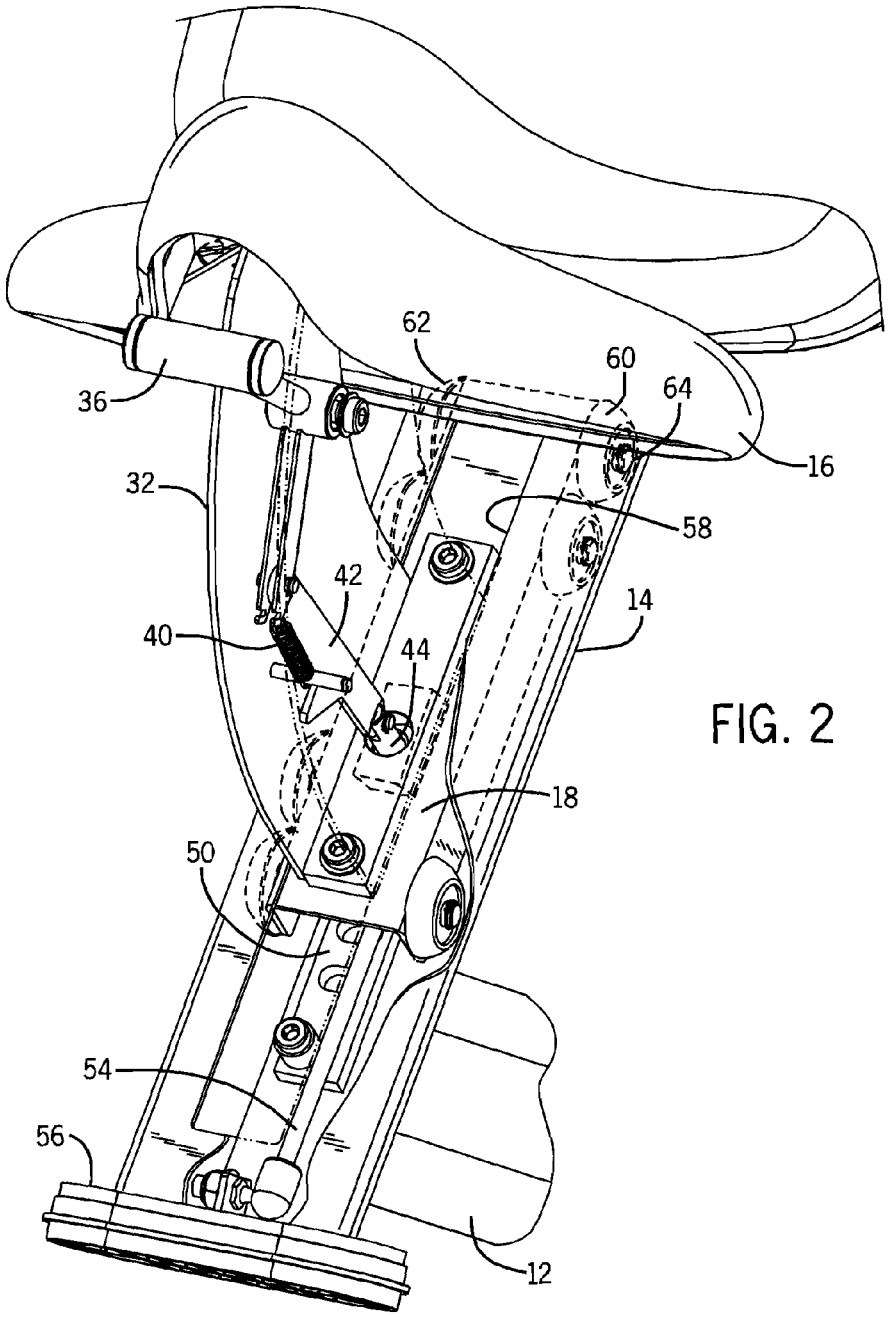
FIG. 2 is an enlarged view of a portion of FIG. 1 partially cut away.
Figure 3:
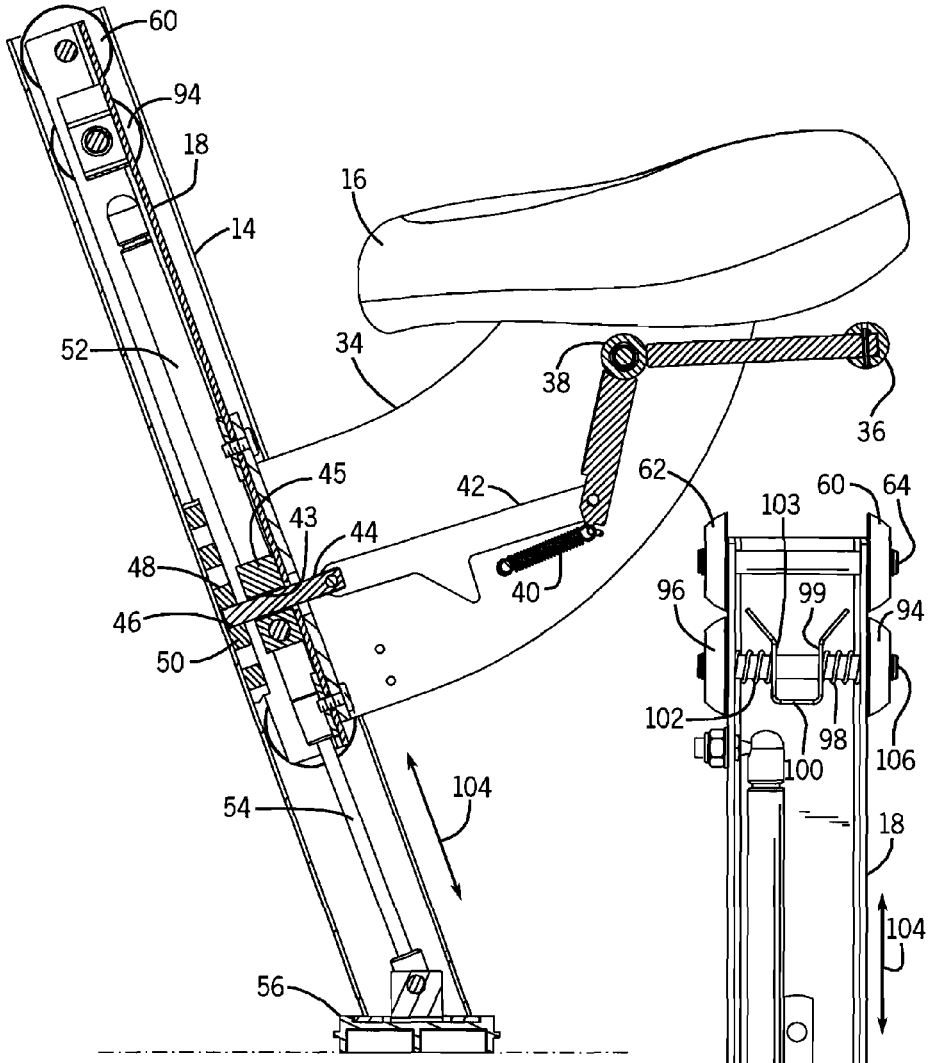
FIG. 3 is a side view of the assembly of FIG. 2 partially broken away.

FIG. 1 shows exercise apparatus 10 including a frame 12 having a support column 14, and a user seat 16 supported on a carriage 18, FIGS. 2, 3, which in turn is adjustably supported on column 14 for up-down movement therealong. Once seated, the user performs an exercise, for example by gripping and moving handles such as 20, 22 to pivot arms such as 24, 26 about a pivot such as 28 which structure is connected through a pulley system (not shown) to a resistance mechanism such as weight stack 30, all as is known. Seat 16 is connected by a pair of yokes 32, 34 to carriage 18. An adjustment handle 36 is pivotally mounted between the yokes at axle 38, FIG. 3, such that upward pivoting of handle 36 about pivot 38 against the bias of tension spring 40 pulls link 42 rightwardly in FIG. 3 to in turn pull pin 44 out of slot 46, whereupon seat 16 may be moved up or down along column 14 to a different position, whereat handle 36 is released to return to its normal downwardly pivoted position about pivot 38 due to the bias of spring 40, whereupon pin 44 enters another slot such as 48 at the adjusted new position of the seat, all as is known. The noted slots are formed in a plate or base member 50 fixedly attached to column 14. Pin 44 slidably extends through aperture 43 through guide block 45 which is fixedly attached to carriage 18. A cylinder 52 and piston 54 arrangement provides upward bias to carriage 18 and seat 16 such that when the user pulls handle 36 upwardly and slightly lifts himself/herself from the seat, the seat will move upwardly, whereas if the user keeps his/her weight on the seat, the seat will move downwardly. Cylinder 52 is fixedly mounted to carriage 18, and piston 54 is fixedly mounted at its lower end to a base pad 56 at the bottom of column 14. Piston 54 is biased to an extended position out of cylinder 52, to provide the noted upward bias to carriage 18 and seat 16, all as is known.

Figure 4:
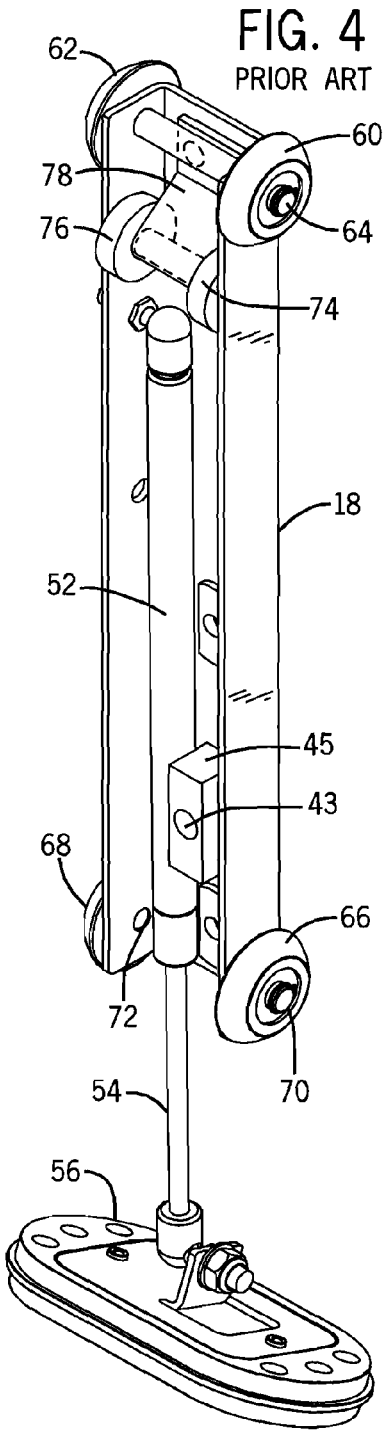
FIG. 4 PRIOR ART
FIG. 4 is a perspective view of a carriage assembly known in the prior art.
Figure 5:
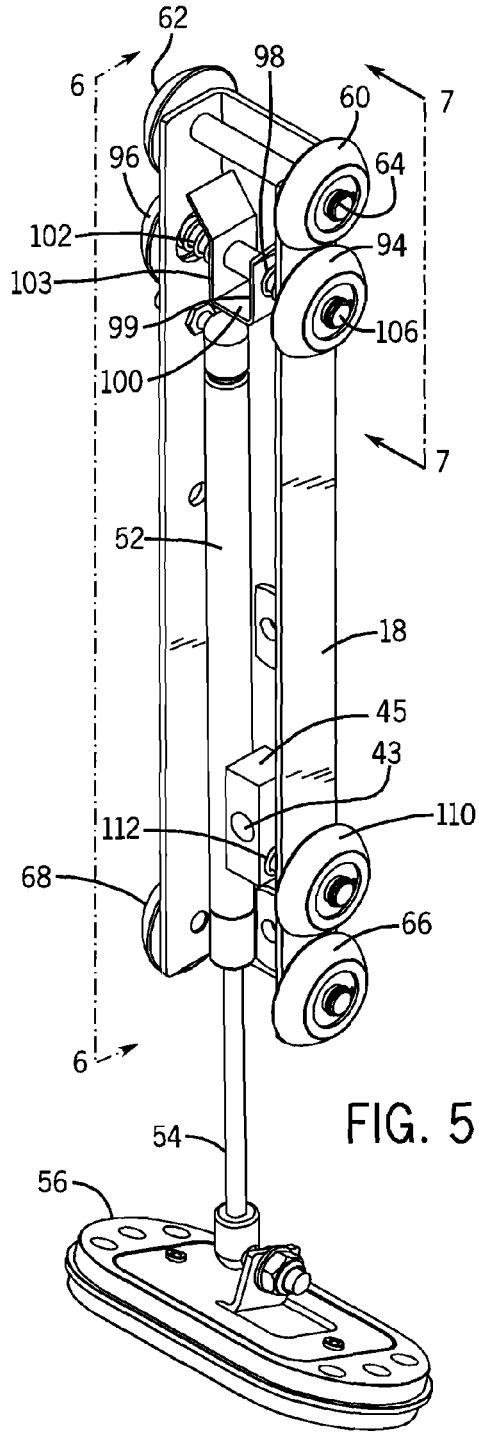
FIG. 5 is a perspective view of a carriage assembly in accordance with the invention.

As is known, column 14 is an elliptical or oval or racetrack shaped hollow tube receiving carriage 18 therein and having a front open groove or slot 58 receiving seat support yokes 32, 34 and adjustment pin 44 therethrough. The internal curved surfaces of the elliptical or oval or racetrack shaped column form a guide track for guiding movement of the carriage therealong via carriage rollers 60, 62 on axle 64, FIGS. 2, 4, and via carriage rollers 66, 68 on axles 70, 72. These four fixed-position rollers guide the carriage within the elliptical or oval or racetrack shaped tubular column 14. Carriage 18 is subject to side-to-side wobble when the user adjusts the seat prior to performing an exercise, which looseness is a result of clearance between the rollers, axles, and internal wall of the oval or racetrack shaped tube that the carriage rides within. A known solution to this problem is to provide a set of secondary rollers 74, 76, FIG. 4, on a bracket 78 which is screw-adjusted during the assembly process. This provides a slight improvement, however it has been found that the problem still persists because a one-time fixed adjustment does not maintain tight running tolerances as the carriage moves to different positions within the elliptical or oval or racetrack shaped tubular column and encounters variations in geometry.

Figure 6:
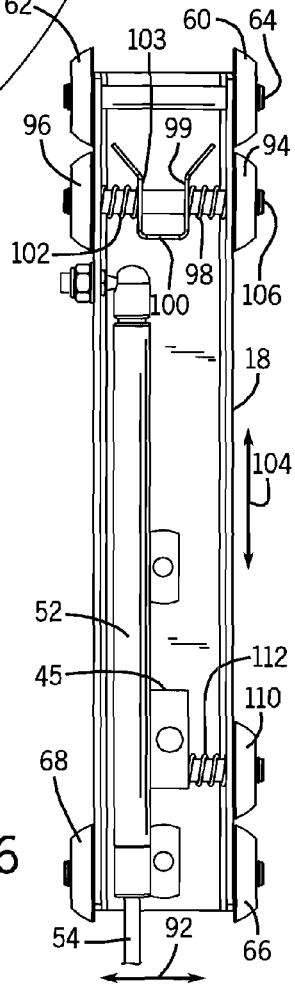
FIG. 6 is a view taken along line 6-6 of FIG. 5.
Figure 7:
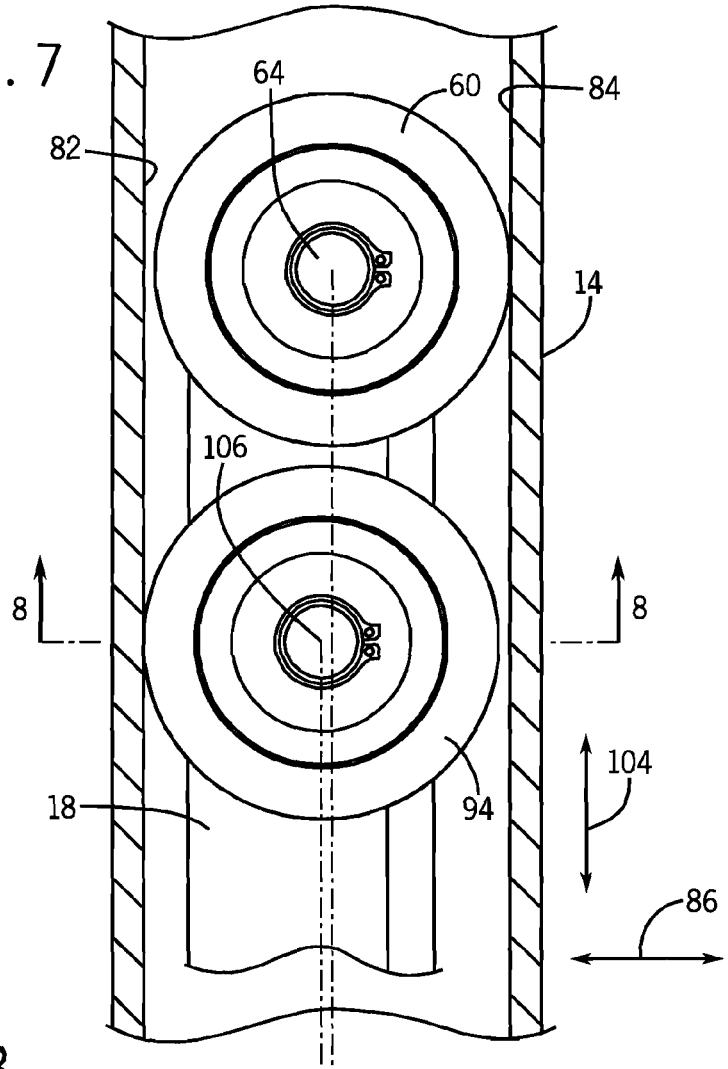
FIG. 7 is a view taken along line 7-7 of FIG. 5.
Figure 8:
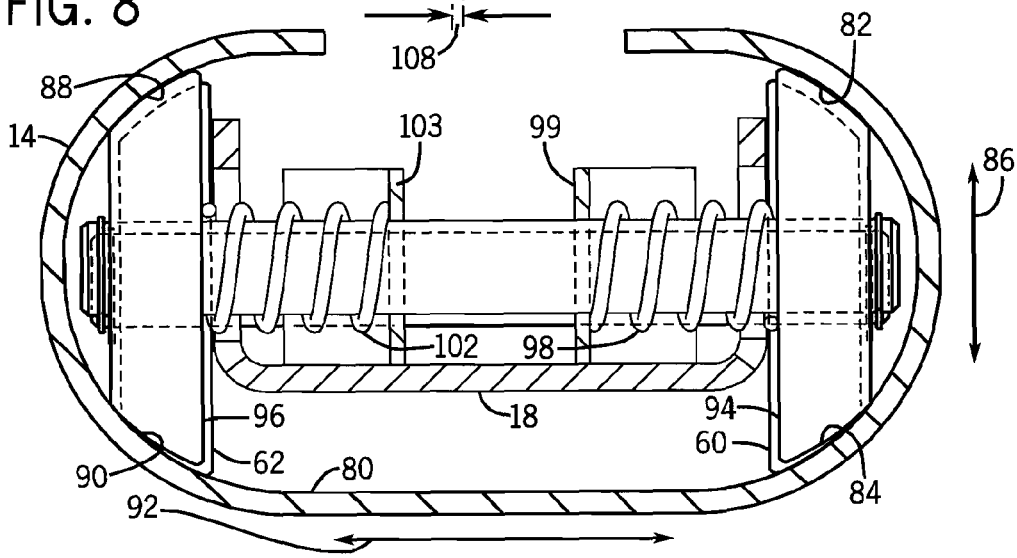
FIG. 8 is a view taken along line 8-8 of FIG. 7.

The present solution is shown in FIGS. 5-8, which use like numerals from above where appropriate to facilitate understanding. Tubular support column 14 has an internal surface, as noted above, forming a guide track 80, FIG. 8, for guiding movement of carriage 18 therealong to a plurality of positions to provide an adjustable seat position for a user, as above noted. Guide track 80 has a first set of guide surfaces provided by distally opposite first and second guide surfaces 82 and 84 spaced from each other along a transverse direction 86. Guide track 80 has a second set of guide surfaces provided by distally opposite third and fourth guide surfaces 88 and 90 spaced from each other along transverse direction 86. The second set of guide surfaces 88, 90 are laterally spaced from the first set of guide surfaces 82, 84 along a lateral direction 92 normal to transverse direction 86. The movement of carriage 18 along tubular support column 14 is normal to each of transverse direction 86 and lateral direction 92. In FIG. 8, the movement of carriage 18 along tubular support column 14 is into and out of the page. Carriage 18 has a first set of rollers provided by the noted pair of main rollers 60 and 62 and the pair of main rollers 66 and 68. First main roller 60 engages second guide surface 84, FIG. 7, and rolls therealong. Second main roller 62 engages fourth guide surface 90 and rolls therealong. Carriage 18 has a second set of rollers provided by a pair of auxiliary resiliently biased rollers 94 and 96 spaced along lateral direction 92. First auxiliary resiliently biased roller 94 engages first guide surface 82 and rolls therealong. Roller 94 is biased rightwardly in FIGS. 5, 6, 8 by a compression spring 98 bearing against leg 99, FIGS. 5, 6, of a U-shaped flange 100 fixedly mounted to carriage 18. The resilient bias of auxiliary resiliently biased roller 94 provides zero clearance between auxiliary roller 94 and first guide surface 82, FIG. 7, and also provides zero clearance between main roller 60 and second guide surface 84. Second auxiliary resiliently biased roller 96 engages third guide surface 88 and rolls therealong. Auxiliary roller 96 is resiliently biased leftwardly in FIGS. 5, 6, 8 by compression spring 102 bearing against leg 103, FIGS. 5, 6, of U-shaped flange 100. The resilient bias of second auxiliary resiliently biased roller 96 provides zero clearance between auxiliary roller 96 and third guide surface 88, and also provides zero clearance between second main roller 62 and fourth guide surface 90.

First and second main rollers 60 and 62 rotate about a first axis 64 lying in a first plane, which is the plane of the page in FIG. 6. Such first plane extends along lateral direction 92, and also extends along the direction of up-down movement 104 of carriage 18 along support column 14. Such first plane is normal to transverse direction 86. First and second auxiliary resiliently biased rollers 94 and 96 rotate about a second axis along axle 106, which second axis lies in a second plane. Such second plane extends along lateral direction 92, and also extends along the direction of up-down movement 104 of carriage 18 along support column 14. The noted second plane is normal to transverse direction 86. The noted second plane is parallel to the noted first plane and offset therefrom along transverse direction 86, for example as shown in FIG. 7 at offset 108 between roller axes 64 and 106.

Guide surfaces 82, 84, 88, 90 extend along respective angles relative to the noted transverse and lateral directions 86 and 92 such that the guide surfaces have vector components along each of the noted transverse and lateral directions 86 and 92. Rollers 60, 62, 94, 96 have outer circumferences extending along respective angles relative to the noted transverse and lateral directions 86 and 92 such that the outer circumferences of the rollers engage the guide surfaces in complemental relation. First and second auxiliary rollers 94 and 96 are resiliently biased along lateral direction 92 into engagement with first and third guide surfaces 82 and 88 with a lateral force vector thereagainst, respectively. The complemental engagement of the outer surfaces of the rollers and the guide surfaces along the noted angles translate the lateral force vector along direction 92 to a transverse force vector along direction 86 to provide the noted zero clearance.

Third and fourth main rollers 66 and 68 are spaced from each other along lateral direction 92. Third main roller 66 engages one of first and second guide surfaces 82 and 84, and fourth main roller 68 engages one of third and fourth guide surfaces 88 and 90. Third and fourth main rollers 66 and 68 are spaced from first and second main rollers 60 and 62 along the noted direction of up-down movement 104 of carriage 18 along support column 14. A third auxiliary resiliently biased roller 110 engages the other of first and second guide surfaces 82 and 84 and rolls therealong. Third auxiliary roller 110 is biased laterally rightwardly in FIGS. 5, 6 by a resilient compression spring 112 bearing against block 45 mounted on the carriage. Third auxiliary resiliently biased roller 110 provides zero clearance for main roller 66 by translating the lateral force vector along lateral direction 92 to a transverse force vector along transverse direction 86, as above noted.

The present system provides a tolerance-compensating engagement system engaged between carriage 18 and tubular support column 14 and bearing therebetween in biased relation to eliminate or at least minimize wobble of carriage 18 and seat 16 on column 14, including during adjustment thereof. The engagement system includes a first mounting system 60, 62 mounting the carriage on the column for the noted up-down movement therealong along direction 104, and a second biased mounting system 94, 96 mounting the carriage on the column for the noted up-down movement therealong and also biasing the first mounting system 60, 62 into biased engagement with the column. The first mounting system engages one of the guide surfaces such as 84, 90, and the second mounting system 94, 96 engages the other of the guide surfaces such as 82, 88. The second mounting system includes a biasing member 98, 102 providing the noted biased engagement. Biasing member 98, 102 biases the noted first and second mounting systems in opposite directions into engagement with respective opposite guide surfaces, for example as shown at offset 108 and opposite guide surfaces 82 and 84 in FIG. 7. In some embodiments, it may be desirable to provide ball bearing rollers 60, 62, 94, 96, 110, 66, 68, i.e. the rollers are journaled on their respective shafts by ball bearings, particularly if the spring loading provided by springs 98, 102, 112 objectionably increases friction. For example, in one embodiment, the spring loading force is nominally 20 pounds, and ball bearing rollers are preferably used to reduce friction.

It is recognized that various equivalents, alternatives and modifications are possible within the scope of the appended claims.

What is claimed is:

1. Exercise apparatus comprising a frame having a support column, a user seat supported on a carriage adjustably supported on said column for up-down movement therealong to a plurality of positions to provide an adjustable seat position for a user, a tolerance-compensating engagement system engaged between said carriage and said column and bearing therebetween in biased relation to minimize wobble of said carriage on said column, said tolerance-compensating engagement system comprising first and second mounting systems mounting said carriage on said column for said up-down movement therealong, said second mounting system including a biasing member having first and second ends and an engagement member having first, second and third surfaces, said first surface of said engagement member engaging said column and movable therealong with said carriage, said second surface of said engagement member engaging said carriage and movable therewith as said carriage moves along said column, said biasing member bearing respectively at said first and second ends between said carriage and said third surface of said engagement member to bias said first surface of said engagement member into engagement with said column in said biased relation.

2. The exercise apparatus according to claim 1 wherein:

said column has a pair of distally opposite guide surfaces;

said first mounting system engages one of said guide surfaces;

said second mounting system engages the other of said guide surfaces.

3. The exercise apparatus according to claim 2 wherein said biasing member biases said first and second mounting systems in opposite directions into engagement with respective said opposite guide surfaces.

4. Exercise apparatus comprising a frame having a support column, a user seat supported on a carriage adjustably supported on said column for up-down movement therealong, said column forming a guide track for guiding movement of said carriage therealong to a plurality of positions to provide an adjustable seat position for a user, said guide track having a first set of guide surfaces comprising distally opposite first and second guide surfaces spaced from each other along a transverse direction, said guide track having a second set of guide surfaces comprising distally opposite third and fourth guide surfaces spaced from each other along said transverse direction, said second set of guide surfaces being laterally spaced from first set of guide surfaces along a lateral direction normal to said transverse direction, the movement of said carriage along said column being normal to each of said transverse direction and said lateral direction, said carriage having a first set of rollers comprising at least one pair of main rollers comprising first and second main rollers spaced from each other along said lateral direction, said first main roller engaging said second guide surface and rolling therealong, said second main roller engaging said fourth guide surface and rolling therealong, said carriage having a second set of rollers comprising a pair of auxiliary resiliently biased rollers comprising first and second auxiliary resiliently biased rollers spaced along said lateral direction, said first auxiliary resiliently biased roller engaging said first guide surface and rolling therealong, the resilient bias of said first auxiliary resiliently biased roller providing zero clearance between said first auxiliary resiliently biased roller and said first guide surface and also providing zero clearance between said first main roller and said second guide surface, said second auxiliary resiliently biased roller engaging said third guide surface and rolling therealong, the resilient bias of said second auxiliary resiliently biased roller providing zero clearance between said second auxiliary resiliently biased roller and said third guide surface and also providing zero clearance between said second main roller and said fourth guide surface.

5. The exercise apparatus according to claim 4 wherein said first and second main rollers rotate about a first axis lying in a first plane, said first plane extending along said lateral direction and also extending along the direction of said up-down movement of said carriage along said column, said first plane being normal to said transverse direction, said first and second auxiliary resiliently biased rollers rotate about a second axis lying in a second plane, said second plane extending along said lateral direction and also extending along the direction of said up-down movement of said carriage along said column, said second plane being normal to said transverse direction, said second plane being parallel to said first plane and offset therefrom along said transverse direction.

6. The exercise apparatus according to claim 5 wherein said guide surfaces extend along respective angles relative to said transverse and lateral directions such that said guide surfaces have vector components along each of said transverse and lateral directions, and said rollers have outer circumferences extending along respective angles relative to said transverse and lateral directions such that said outer circumferences of said rollers engage said guide surfaces in complemental relation, and wherein said first and second auxiliary resiliently biased rollers are biased along said lateral direction into engagement with said first and third guide surfaces with a lateral force vector thereagainst, respectively, said complemental engagement of said outer circumferences of said rollers and said guide surfaces along said angles translating said lateral force vector to a transverse force vector to provide said zero clearance.

7. The exercise apparatus according to claim 6 wherein said first set of rollers comprises a second pair of main rollers comprising third and fourth main rollers spaced from each other along said lateral direction, said third main roller engaging one of said first and second guide surfaces, said fourth main roller engaging one of said third and fourth guide surfaces, said third and fourth main rollers being spaced from first and second main rollers along said direction of up-down movement of said carriage along said column.

8. The exercise apparatus according to claim 7 comprising a third auxiliary resiliently biased roller engaging the other of said first and second guide surfaces and rolling therealong.

* * * * *